US007122508B2

(12) United States Patent
Boffa

(10) Patent No.: US 7,122,508 B2
(45) Date of Patent: Oct. 17, 2006

(54) METHODS AND COMPOSITIONS FOR REDUCING WEAR IN INTERNAL COMBUSTION ENGINES LUBRICATED WITH A LOW PHOSPHOROUS CONTENT BORATE-CONTAINING LUBRICATING OIL

(75) Inventor: Alexander B. Boffa, Richmond, CA (US)

(73) Assignee: Chevron Oronite Company LLC, San Ramon, CA (US)

( * ) Notice: Subject to any disclaimer, the term of this patent is extended or adjusted under 35 U.S.C. 154(b) by 81 days.

(21) Appl. No.: 10/285,752

(22) Filed: Oct. 31, 2002

(65) Prior Publication Data

US 2004/0087450 A1 May 6, 2004

(51) Int. Cl.
*C10M 125/26* (2006.01)
*C10M 137/00* (2006.01)

(52) U.S. Cl. ..... 508/159; 508/371; 508/424; 508/425; 508/427; 508/433; 508/436; 508/441

(58) Field of Classification Search ..... 508/155–160
See application file for complete search history.

(56) References Cited

U.S. PATENT DOCUMENTS

| | | | | |
|---|---|---|---|---|
| 3,997,454 | A | 12/1976 | Adams | |
| 3,997,457 | A | 12/1976 | Takahashi et al. | |
| 4,089,790 | A | 5/1978 | Adams | 252/18 |
| 4,163,729 | A | 8/1979 | Adams | 252/18 |
| 4,431,552 | A | 2/1984 | Salentine | |
| 4,472,288 | A | 9/1984 | Frost, Jr. | |
| 4,495,075 | A | 1/1985 | Buckley | 252/32.7 |
| 4,534,873 | A | 8/1985 | Clark | 252/32.7 |
| 4,717,490 | A * | 1/1988 | Salentine | 508/159 |
| 4,975,096 | A | 12/1990 | Buckley, III | 44/433 |
| 5,635,459 | A | 6/1997 | Stoffa et al. | 508/186 |
| 5,962,377 | A | 10/1999 | Baumgart et al. | 508/168 |
| 6,534,450 | B1 * | 3/2003 | Harrison et al. | 508/158 |
| 6,569,818 | B1 * | 5/2003 | Nakazato et al. | 508/185 |
| 6,632,781 | B1 * | 10/2003 | Harrison et al. | 508/158 |
| 6,696,393 | B1 * | 2/2004 | Boffa | 508/287 |
| 6,730,638 | B1 * | 5/2004 | Farng et al. | 508/194 |
| 6,737,387 | B1 * | 5/2004 | Harrison et al. | 508/158 |
| 6,777,378 | B1 * | 8/2004 | Abraham et al. | 508/185 |
| 6,784,143 | B1 * | 8/2004 | Locke et al. | 508/460 |

FOREIGN PATENT DOCUMENTS

| | | |
|---|---|---|
| EP | 0 814 148 B1 | 12/1997 |
| EP | 1 057 883 A2 | 12/2000 |

OTHER PUBLICATIONS

Beck, et al., *Impact of Oil-Derived Catalyst Poisons on FTP Performance of LEV Catalyst Systems*, SAE Technical Paper 972842 (1997).

Johnson, et al., *Effects of Oil-Derived Contaminants on Emissions from TWC-Equipped Vehicles*, SAE 200-01-1881 (2000).

* cited by examiner

*Primary Examiner*—Ellen M. McAvoy
(74) *Attorney, Agent, or Firm*—Josetta I. Jones

(57) ABSTRACT

Disclosed are methods and lubricant compositions for reducing wear in internal combustion engines lubricated with a low phosphorous content lubricating oil. The lubricant compositions of this invention comprise a synergistic combination of a dispersed, hydrated, alkali metal borate and at least one phosphorous-containing compound wherein the total phosphorous employed in the composition is no more than about 0.08 weight percent based on the total weight of the composition.

7 Claims, No Drawings

METHODS AND COMPOSITIONS FOR REDUCING WEAR IN INTERNAL COMBUSTION ENGINES LUBRICATED WITH A LOW PHOSPHOROUS CONTENT BORATE-CONTAINING LUBRICATING OIL

FIELD OF THE INVENTION

This invention is directed, in part, to methods and lubricant compositions for reducing wear in internal combustion engines lubricated with a low phosphorous content lubricating oil. The lubricant compositions of this invention comprise a synergistic combination of an anti-wear effective amount of a dispersed, hydrated alkali metal borate and at least one oil-soluble, phosphorous-containing, anti-wear compound wherein the total phosphorous employed in the composition is no more than about 0.08 weight percent based on the total weight of the composition.

REFERENCES

The following references are cited in this application as superscript numbers:

[1]Buckley, III, *Long Chain Aliphatic Hydrocarbyl Amine Additives Having an Oxyalkylene Hydroxy Connecting Group*, U.S. Pat. No. 4,975,096, issued Dec. 4, 1990

[2]Buckley, *Methods and Compositions for Preventing the Precipitation of Zinc Dialkyldithiophosphates Which Contain High Percentages of a Lower Alkyl Group*, U.S. Pat. No. 4,495,075, issued Jan. 22, 1985

[3]Beck, et al., *Impact of Oil-Derived Catalyst Poisons on FTP Performance of LEV Catalyst Systems*, SAE Technical Paper 972842 (1997)

[4]Johnson, et al., *Effects of Oil-Derived Contaminants on Emissions from TWC-Equipped Vehicles*, SAE 200-01-1881 (2000)

[5]Baumgart, et al, *Lubricant Additive Formulation*, U.S. Pat. No. 5,962,377, issued Oct. 5, 1999

[6]Adams, *Synergistic Combination of Hydrated Potassium Borate, Anti-wear Agents, and Organic Sulfide Antioxidants*, U.S. Pat. No. 4,089,790, issued May 16, 1978

[7]Adams, *Synergistic Combination of Hydrated Potassium Borate, Anti-wear Agents, and Organic Sulfide Antioxidants*, U.S. Pat. No. 4,163,729, issued Aug. 7, 1979

[8]Stoffa, et al., *Borated Overbased Sulfonates for Improved Gear Performance in Functional Fluids*, U.S. Pat. No. 5,635,459, issued Jun. 3, 1997

[9]Clark, *Automotive Friction Reducing Composition*, U.S. Pat. No. 4,534,873, issued Aug. 13, 1985

All of the above references are herein incorporated by reference in their entirety to the same extent as if each individual reference was specifically and individually indicated to be incorporated by reference in its entirety.

STATE OF THE ART

Emissions arising from automotive exhaust has been a problem for several decades and approaches for addressing this problem have included the use of unleaded fuel (to deal, in part, with lead emissions arising from leaded fuels), oxygenated fuel (to reduce hydrocarbon emissions), the use of catalytic converters (also to reduce hydrocarbon emissions), etc.

Catalytic converters are now universally employed with gasoline powered vehicles and the efficiency of these converters is directly related to the ability of the catalyst to effect conversion of unburnt or partially burnt hydrocarbons generated during combustion to carbon dioxide and water. One problem arising with the use of such converters is poisoning of the catalyst resulting in reduce catalyst efficiency. Since catalytic converters are intended for extended use, catalyst poisoning results in higher levels of atmospheric discharges of pollutants from internal combustion engines over prolonged periods of time.

In order to minimize such poisoning, the industry has set standards for both fuel and lubricant contents. For example, standards for fuels have included the use of unleaded gasoline in order to avoid lead poisoning of the catalyst[1] as well as lead discharge into the environment.

As to the lubricants, one additive family currently being addressed by industry standards is the phosphorous-containing additives used in lubricant compositions employed to lubricate internal combustion engines. Specifically, phosphorous-containing additives reach the catalytic converter as a result of, for example, exhaust gas recirculation and/or oil blow-by processes as well as other methods known in the art. See, for example, Beck, et al. and Johnson, et al.[3,4] In any event, phosphorous is known to accumulate in the catalytic converter and at active metal sites; thus reducing catalyst efficiency and effectively over time, poisoning the catalyst. As a result of the above, a new focus is to lower phosphorous in the lubricating oils. For example, the draft GF-4 specifications for lubricant compositions have proposed significantly lower phosphorous contents than heretofore employed.

A problem arises when the level of phosphorous is reduced in a lubricant composition containing an oil-soluble, phosphorous-containing, anti-wear compound in that there is a significant reduction in anti-wear performance arising from this diminution in phosphorous content. One well known class of anti-wear additives are metal alkylphosphates, especially zinc dialkyl dithiophosphates, which are generally employed in lubricating oils at phosphorous levels above 0.1 weight percent when used for wear control. At lower levels, it is not found to be an effective anti-wear additive. For instance, as exemplified herein, lowering the level of phosphorous due to the presence of the zinc dithiophosphate additive in a lubricant composition by one-half from 0.095 weight percent to 0.048 weight percent phosphorous results in about a seven-fold increase in engine wear.

This invention is directed to the discovery that lubricant compositions comprising a combination of a complex of a dispersed, hydrated, alkali metal borate and low levels of one or more oil-soluble, phosphorous-containing, anti-wear compounds synergistically reduce wear levels when used to lubricate gasoline engines.

With regard to the above, lubricant compositions comprising both metal dialkyl dithiophosphates and borated esters of sulfonic and carboxylic acids are disclosed in, for example, U.S. Pat. No. 5,962,377.[5]

Additionally, functional fluids useful as gear lubricants have previously employed combinations of phosphorus compounds such as zinc dihydrocarbyl dithiophosphates and hydrated, alkali metal borates.[6,7,8] Such compositions can employ up to 5 weight percent of the phosphorus compound[6,7] or, in the case of Stoffa, et al.[8], up to 4 weight percent of the phosphorus compound.

Lubricant compositions containing a combination of three extreme pressure, anti-wear agents comprising a dispersed, hydrated potassium borate, an antimony dithiophosphate and a liquid chlorinated paraffin are disclosed by Clark.[9]

Such compositions can comprise up to 1.4 volume percent of the antimony dithiophosphate in the finished lubricant composition.

SUMMARY OF THE INVENTION

As noted above, this invention is directed, in part, to lubricant compositions comprising a combination of a dispersed, hydrated, alkali metal borate and at least one oil-soluble, phosphorous-containing anti-wear compound wherein the total phosphorous employed in the composition is no more than about 0.08 weight percent based on the total weight of the composition. This combination of additives synergistically reduces wear levels when used in lubricant compositions to lubricate internal combustion engines.

Accordingly, in one of its composition aspects, this invention is directed to a lubricating oil composition comprising a major amount of an oil of lubricating viscosity, at least one oil-soluble, phosphorous-containing, anti-wear compound wherein the weight percent of total phosphorous in the composition is no more than about 0.08 weight percent based on the total weight of the composition; and an anti-wear effective amount of a dispersed, hydrated, alkali metal borate.

In a preferred embodiment, the total phosphorous in the composition is no more than 0.06 and even more preferably no more than about 0.05 weight percent based on the total weight of the composition.

Preferably, the oil-soluble, phosphorous-containing, anti-wear compound is selected from the group consisting of metal dithiophosphates, phosphorous esters (including phosphates, phosphonates, phosphinates, phosphine oxides, phosphites, phosphonites, phosphinites, phosphines and the like), amine phosphates and amine phosphinates, sulfur-containing phosphorous esters including phosphoro monothionate and phosphoro dithionates, phosphoramides, phosphonamides and the like. More preferably, the phosphorous-containing compound is a metal dithiophosphate and, even more preferably, a zinc dithiophosphate.

In another preferred embodiment, the dispersed hydrated alkali metal borate is present in an amount of from about 0.2 to about 5 weight percent of the total weight of the lubricant composition and, even more preferably, from about 0.5 to 2 weight percent.

Preferably, the dispersed hydrated alkali metal borate is a dispersed hydrated potassium borate.

In one of its method aspects, this invention is directed to a method for controlling wear during operation of an internal combustion engine, which method comprises operating the engine with a lubricant composition comprising a major amount of an oil of lubricating viscosity, at least one oil-soluble, phosphorous-containing, anti-wear compound wherein the weight percent of total phosphorous in the composition is no more than about 0.08 weight percent based on the total weight of the composition, and an anti-wear effective amount of a dispersed, hydrated alkali metal borate.

DETAILED DESCRIPTION OF THE INVENTION

This invention is directed, in part, to novel lubricant compositions comprising a combination of a dispersed, hydrated alkali metal borate and at least one oil-soluble, anti-wear, phosphorous-containing compound wherein the total phosphorous employed in the composition is no more than about 0.08 weight percent based on the total weight of the composition.

Each of these components in the claimed composition will be described in detail herein. However, prior to such a description, the following terms will first be defined.

The term "an oil-soluble, phosphorous-containing, anti-wear compound" refers to additives in lubricant compositions that contain phosphorous and which exhibit an anti-wear benefit, either alone or when used in combination with other additives, during operation of an internal combustion engine that is lubricated with such a lubricant composition. The phosphorous in such additives is typically integral to the additive.

The term "total phosphorous" refers to the total amount of phosphorous in the lubricant composition regardless of whether such phosphorous is present as part of an oil-soluble, phosphorous-containing, anti-wear compound or in the form of a contaminant in the lubricant composition such as residual phosphorous remaining due to the presence of $P_2S_5$ used to prepare metal dihydrocarbyl dithiophosphates. In either event, the amount of phosphorous permitted in the lubricant composition is independent of source. Preferably, however, the phosphorous is part of a lubricant additive.

The Hydrated Alkali Metal Borate

Hydrated alkali metal borates are well known in the art. Representative patents disclosing suitable borates and methods of manufacture include: U.S. Pat. Nos. 3,313,727; 3,819,521; 3,853,772; 3,912,643; 3,997,454; and 4,089,790 all of which are incorporated herein by reference in their entirety.

The hydrated alkali metal borates suitable for use in the present invention can be represented by the following general formula:

$$M_2O.xB_2O_3.yH_2O$$

wherein M is an alkali metal, preferably sodium or potassium; x is a number from 2.5 to 4.5 (both whole and fractional); and y is a number from 1.0 to 4.8. More preferred are the hydrated potassium borates, particularly the hydrated potassium triborates. The hydrated borate particles will generally have a mean particle size of less than 1 micron.

In the alkali metal borates employed in this invention, the ratio of boron to alkali metal will preferably range from about 2.5:1 to about 4.5:1.

Oil dispersions of hydrated alkali metal borates are generally prepared by forming, in deionized water, a solution of alkali metal hydroxide and boric acid, optionally in the presence of a small amount of the corresponding alkali metal carbonate. The solution is then added to a lubricant composition comprising an oil of lubricating viscosity, a dispersant and any optional additives to be included therein (e.g., a detergent, or other optional additives) to form an emulsion that is then dehydrated.

Because of their retention of hydroxyl groups on the borate complex, these complexes are referred to as "hydrated alkali metal borates" and compositions containing oil/water emulsions of these hydrated alkali metal borates are referred to as "oil dispersions of hydrated alkali metal borates".

Preferred oil dispersions of alkali metal borates will have a boron to alkali metal ratio of about 2.5:1 to about 4.5:1. In another preferred embodiment, the hydrated alkali metal borate particles generally will have a mean particle size of less than 1 micron. In this regard, it has been found that the hydrated alkali metal borates employed in this invention preferably will have a particle size where 90% or greater of the particles are less than 0.6 microns.

In the oil dispersion of hydrated alkali metal borate, the hydrated alkali metal borate will generally comprise about 10 to 75 weight percent, preferably 25 to 50 weight percent, more preferably about 30 to 40 weight percent of the total weight of the oil dispersion of the hydrated borate. (Unless otherwise stated, all percentages are in weight percent.) This composition or concentrate is employed, often in the form of an additive package, to form the finished lubricant composition. Sufficient amounts of the concentrate are added so that the finished lubricant composition preferably comprises from about 0.2 to about 5 weight percent of the total weight of the lubricant composition and, even more preferably, from about 0.5 to 2 weight percent.

The lubricant compositions of this invention can further employ surfactants, detergents, other dispersants and other conditions as described below and known to those skilled in the art.

The oil dispersions of hydrated alkali metal borates employed in this invention generally comprise a dispersant, an oil of lubricating viscosity, and optionally a detergent.

The Phosphorous-Containing Compound

Preferably, the oil-soluble, phosphorous-containing, anti-wear compound employed in the compositions and methods of this invention is selected from the group consisting of metal dithiophosphates, phosphorous esters (including phosphates, phosphonates, phosphinates, phosphine oxides, phosphites, phosphonites, phosphinites, phosphines and the like), amine phosphates and amine phosphinates, sulfur-containing phosphorous esters including phosphoro monothionate and phosphoro dithionates, phosphoramides, phosphonamides and the like; all of which are well known in the art. More preferably, the phosphorous-containing compound is a metal dithiophosphate and, even more preferably, a zinc dithiophosphate. Most preferably, the phosphorous containing compound is a zinc dialkyl dithiophosphate wherein the alkyl groups are independently selected from C3 to C13, branched or straight chain carbon groups including mixtures thereof. Even more preferable, the phosphorous containing compound is zinc(II) bis(0,0'-di-(2-butyl/4-emthyl-2-pentyl) dithiophosphate.

The metal dithiophosphates are characterized by formula I:

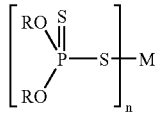

I wherein each R is independently a hydrocarbyl group containing from 3 to about 13 carbon atoms, M is a metal, and n is an integer equal to the valence of M.

The hydrocarbyl groups, R, in the dithiophosphate (or as described elsewhere in this application) can be a $C_3$ to $C_{13}$ alkyl, $C_3$ to $C_{13}$ cycloalkyl, $C_7$ to $C_{13}$ aralkyl or $C_7$ to $C_{13}$ alkaryl groups, or a substantially hydrocarbon group of similar structure. By "substantially hydrocarbon" is meant hydrocarbons that contain substituent groups such as ether, ester, nitro, or halogen which do not materially affect the hydrocarbon character of the group.

Illustrative alkyl groups include isopropyl, isobutyl, n-butyl, sec-butyl, the various amyl groups, n-hexyl, methylisobutyl carbinyl, heptyl, 2-ethylhexyl, dilsobutyl, isooctyl, nonyl, behenyl, decyl, dodecyl, tridecyl, etc. Illustrative lower alkylphenyl groups include butylphenyl, amylphenyl, heptylphenyl, etc. Cycloalkyl groups likewise are useful and these include chiefly cyclohexyl and the lower alkyl-cyclohexyl radicals. Many substituted hydrocarbon groups may also be used, e.g., chlorophentyl, dichlorophenyl, and dichlorodecyl.

In another embodiment, at least one R group is an isopropyl or secondary butyl group. In yet another embodiment, both R groups are secondary alkyl groups.

The phosphorodithioic acids from which the metal salts useful in this invention are prepared are well known. Examples of dihydrocarbyl phosphorodithioic acids and metal salts, and processes for preparing such acids and salts are found in, for example, U.S. Pat. Nos. 4,263,150; 4,289,635; 4,308,154; and 4,417,990. These patents are hereby incorporated by reference for such disclosures.

The phosphorodithioic acids are typically prepared by the reaction of phosphorous pentasulfide with an alcohol or phenol or mixtures of alcohols and/or phenols. The reaction involves four moles of the alcohol or phenol per mole of phosphorous pentasulfide, and may be carried out within the temperature range from about 50° C. to about 200° C. Thus, the preparation of O,O-di-n-hexyl phosphorodithioic acid involves the reaction of phosphorous pentasulfide with four moles of n-hexyl alcohol at about 100° C. for about two hours. Hydrogen sulfide is liberated and the residue is the defined acid. The preparation of the metal salt of this acid may be effected by reaction with metal oxide. Simply mixing and heating these two reactants is sufficient to cause the reaction to take place and the resulting product is sufficiently pure for the purposes of this invention.

The metal dihydrocarbyl dithiophosphates that are useful in this invention include those salts containing Group I metals, Group II metals, zinc, aluminum, lead, tin, molybdenum, manganese, cobalt, and nickel or mixtures thereof. The Group II metals, zinc, aluminum, tin, iron, cobalt, lead, molybdenum, manganese, nickel and copper are among the preferred metals. Zinc and copper either alone or in combination are especially useful metals. Especially preferred is zinc. In one embodiment, the lubricant compositions of the invention contain examples of metal compounds which may be reacted with the acid include lithium oxide, lithium hydroxide, sodium hydroxide, sodium carbonate, potassium hydroxide, potassium carbonate, silver oxide, magnesium oxide, magnesium hydroxide, calcium oxide, zinc hydroxide, zinc oxide, strontium hydroxide, cadmium oxide, cadmium hydroxide, barium oxide, aluminum oxide, iron carbonate, copper hydroxide, lead hydroxide, tin burylate, cobalt hydroxide, nickel hydroxide, nickel carbonate, etc.

In some instances, the incorporation of certain ingredients such as small amounts of the metal acetate or acetic acid (glacial) in conjunction with the metal reactant will facilitate the reaction and result in an improved product. For example, the use of up to about 5% of zinc acetate in combination with the required amount of zinc oxide facilitates the formation of a zinc phosphorodithioate.

In one preferred embodiment, the alkyl groups, R, are derived from secondary alcohols such as isopropyl alcohol, secondary butyl alcohol, 2-pentanol, 4-methyl-2-pentanol, 2-hexanol, 3-hexanol, etc. Preferably R is derived from a mixure of secondary alcohols such as 2-butanol and 4-methyl-2-pentanol. Particulary preferred R is derived from the above mixture containing from about 65–75 weight percent 2-butanol with the remainder 4-methyl-2-pentanol.

Especially useful metal phosphorodithioates can be prepared from phosphorodithioic acids that, in turn, are prepared by the reaction of phosphorous pentasulfide with mixtures of alcohols. In addition, the use of such mixtures enables the utilization of cheaper alcohols which in themselves may not yield oil-soluble phosphorodithioic acids.

Useful mixtures of metal salts of dihydrocarbyl dithiophosphoric acid are obtained by reacting phosphorous pentasulfide with a mixture of (a) isopropyl or secondary butyl alcohol, and (b) an alcohol containing at least 5 carbon atoms wherein at least 10 mole percent, preferably 20 or 25 mole percent, of the alcohol in the mixture is isopropyl alcohol, secondary butyl alcohol or a mixture thereof.

Thus, a mixture of isopropyl and hexyl alcohols can be used to produce a very effective, oil-soluble metal phosphorodithioate. For the same reason, mixtures of phosphorodithoic acids can be reacted with the metal compounds to form less expensive, oil-soluble salts.

The mixtures of alcohols may be mixtures of different primary alcohols, mixtures of different secondary alcohols or mixtures of primary and secondary alcohols. Examples of useful mixtures include: n-butanol and n-octanol; n-pentanol and 2-ethyl-1-hexanol; isobutanol and n-hexanol; isobutanol and isoamyl alcohol; isopropanol and 4-methyl-2-pentanol; isopropanol and sec-butyl alcohol; isopropanol and isooctyl alcohol; sec-butyl alcohol and 4-methyl-2-pentaol, etc. Particularly useful alcohol mixtures are mixtures of secondary alcohols containing at least about 20 mole percent and preferably at least 40 mole percent of isopropyl alcohol. In a preferred embodiment, at least 75 mole percent of sec-butyl alcohol is used and preferably combined with 4-methyl-2-pentanol, and most preferably further combined with a zinc metal.

Particularly preferred metal dihydrocarbyl phosphorodithioates include the zinc dithiophosphates. Patents describing the synthesis of such zinc dithiophosphates include U.S. Pat. Nos. 2,680,123; 3,000,822; 3,151,075; 3,385,791; 4,377,527; 4,495,075 and 4,778,906. Each of these patents is incorporated herein by reference in their entirety.

The following examples illustrate the preparation of metal phosphorodithioates and resulting metal dialkyldithiophosphates prepared from mixtures of alcohols.

EXAMPLE B1

A phosphorodithioic acid is prepared by reacting a mixture of alcohols comprising 6 moles of 4-methyl-2-pentanol and 4 moles of isopropyl alcohol with phosphorous pentasulfide. The phosphorodithioic acid then is reacted with an oil slurry of zinc oxide. The amount of zinc oxide in the slurry is about 1.08 times and theoretical amount required to completely neutralize the phosphorodithioic acid. The oil solution of the zinc phosphorodithioate obtained in this manner (10% oil) contains 9.5% phosphorous, 20.0% sulfur and 10.5% zinc.

EXAMPLE B2

A phosphorodithioioc acid is prepared by reacting finely powdered phosphorous pentasulfide with an alcohol mixture containing 11.53 moles (692 parts by weight) of isopropyl alcohol and 7.69 moles (1000 parts by weight) of isooctanol. The phosphorodithioic acid obtained in this manner has an acid number of about 178–186 and contains 10.0% phosphorous and 21.0% sulfur. This phosphorodithioic acid is then reacted with an oil slurry of zinc oxide. The quantity of zinc oxide included in the oil slurry is 1.10 times the theoretical equivalent of the acid number of the phosphorodithioic acid. The oil solution of the zinc salt prepared in this manner contains 12% oil, 8.6% phosphorous, 18.5% sulfur and 9.5% zinc.

EXAMPLE B3

A phosphorodithioic acid is prepared by reacting a mixture of 1560 parts (12 moles) of isooctyl alcohol and 180 parts (3 moles) of isopropyl alcohol with 756 parts (3.4 moles) of phosphorous pentasulfide. The reaction is conducted by heating the alcohol mixture to about 55° C. and thereafter adding the phosphorous pentasulfide over a period of 1.5 hours while maintaining the reaction temperature at about 60–75° C. After all of the phosphorous pentasulfide is added, the mixture is heated and stirred for an additional hour at 70–75° C., and thereafter filtered through a filter aid.

Zinc oxide (282 parts, 6.87 moles) is charged to a reactor with 278 parts of mineral oil. The above-prepared phosphorodithioic acid (2305 parts, 6.28 moles) is charged to the zinc oxide slurry over a period of 30 minutes with an exotherm to 60° C. The mixture then is heated to 80° C. and maintained at this temperature for 3 hours. After stripping to 100° C. and 6 millimeters of mercury, the mixture is filtered twice through a filter aid, and the filtrate is the desired oil solution of the zinc salt containing 10% oil, 7.97% zinc (theory 7.40); 7.21% phosphorous (theory 7.06); and 15.64% sulfur (theory 14.57).

EXAMPLE B4

Isopropyl alcohol (396 parts, 6.6 moles) and 1287 parts (9.9 moles) of isooctyl alcohol are charged to a reactor and heated with stirring to 59° C. Phosphorous pentasulfide (833 parts, 3.75 moles) is then added under a nitrogen sweep. The addition of the phosphorous pentasulfide is completed in about 2 hours at a reaction temperature between 59–63° C. The mixture then is stirred at 45–63° C. for about 1.45 hours and filtered. The filtrate is the desired phosphorodithioic acid.

A reactor is charged with 312 parts (7.7 equivalents) of zinc oxide and 580 parts of mineral oil. While stirring at room temperature, the above-prepared phosphorodithioic acid (2287 parts, 6.97 equivalents) is added over a period of about 1.26 hours with an exotherm to 54° C. The mixture is heated to 78° C. and maintained at 75–85° C. for 3 hours. The reaction mixture is vacuum stripped to 100° C. at 19 millimeters of mercury. The residue is filtered through a filter aid, and the filtrate is an oil solution (19.2% oil) of the desired zinc salt containing 7.86% zinc, 7.76% phosphorous and 14.8% sulfur.

EXAMPLE B5

The general procedure of Example B4 is repeated except that the mole ratio of isopropyl alcohol to isooctyl alcohol is 1:1. The product obtained in this manner is an oil solution (10% oil) of the zinc phosphorodithioate containing 8.96% zinc, 8.49% phosphorous and 18.05% sulfur.

EXAMPLE B6

A phosphorodithioic acid is prepared in accordance with the general procedure of Example B4 utilizing an alcohol mixture containing 520 parts (4 moles) of isooctyl alcohol and 360 parts (6 moles) of isopropyl alcohol with 504 parts (2.27 moles) of phosphorous pentasulfide. The zinc salt is prepared by reacting an oil slurry of 116.3 parts of mineral oil and 141.5 parts (3.44 moles of zinc oxide with 950.8 parts (3.20 moles) of the above-prepared phosphorodithioic acid. The product prepared in this manner is an oil solution (10% mineral oil) of the desired zinc salt, and the oil solution containing 9.36% zinc, 8.81% phosphorous and 18.65% sulfur.

EXAMPLE B7

A mixture of 520 parts (4 moles) of isooctyl alcohol and 559.8 parts (9.33 moles) of isopropyl alcohol is prepared and heated to 60° C. at which time 672.5 parts (3.03 moles) of phosphorous pentasulfide are added in portions while 15 stirring. The reaction then is maintained at 60–65° C. for about one hour and filtered. The filtrate is the desired phosphorodithioic acid.

An oil slurry of 188.6 parts (4 moles) of zinc oxide and 144.2 parts of mineral oil is prepared, and 1145 parts of the above-prepared phosphorodithioic acid are added in portions while maintaining the mixture at about 70° C. After all of the acid is charged, the mixture is heated at 80° C. for 3 hours. The reaction mixture then is stripped of water to 110° C. The residue is filtered through a filter aid, and the filtrate is an oil solution (10% mineral oil) of the desired product containing 9.99% zinc, 19.55% sulfur and 9.33% phosphorous.

EXAMPLE B8

A phosphorodithioic acid is prepared by the general procedure of Example B4 utilizing 260 parts (2 moles) of isooctyl alcohol, 480 parts (8 moles) of isopropyl alcohol, and 504 parts (2.27 moles) of phosphorous pentasulfide. The phosphorodithioic acid (1094 parts, 3.84 moles) is added to an oil slurry containing 181 parts (4.41 moles) of zinc oxide and 135 parts of mineral oil over a period of 30 minutes. The mixture is heated to 80° C. and maintained at this temperature for 3 hours. After stripping to 100° C. and 19 millimeters of mercury, the mixture is filtered twice through a filter aid, and the filtrate is an oil solution (10% mineral oil) of the zinc salt containing 10.06% zinc, 9.04% phosphorous, and 19.2% sulfur.

EXAMPLE B9

Isopropyl alcohol (410 parts, 6.8 moles) and 590 parts (4.5 moles) 2-ethylhexyl alcohol are charged to a reactor and heated to 50° C. Phosphorous pentasulfide (541 parts, 2.4 moles) is added under a nitrogen sweep. The addition is complete in 1.5 hours at a reaction temperature of from 50–65° C. The contents are stirred for 2 hours and filtered at 55° C. to give the desired phosphorodithioic acid.

A reactor is charged with 145 parts (3.57 equivalents) of zinc oxide and 116 parts oil. Stirring is begun and added is 1000 parts (3.24 equivalents) of the above obtained phosphorodithioc acid over a 1 hour period beginning at room temperature. The addition causes an exotherm to 52° C. The contents are heated to 80° C. and maintained at this temperature for 2 hours. The contents are then vacuum stripped to 100° C. at 22 millimeters mercury. Added is 60 parts oil and the contents are filtered to give the desired product containing 12% oil, 9.5% zinc, 18.5% sulfur and 8.6% phosphorous.

EXAMPLE B-10

A mixture of 2-butanol (237 parts, 77 mole) and 4-methyl-2-pentanol (98 parts, 23 mole) was charged to a reactor with 222 parts phosphorous pentasulfide at a temperature of about 75° C. and agitated for a period of about 2 hours. The reaction mixture was cooled and filtered to give the desired phosphorodithioic acid having a neutralization number of 193 (mgs. KOH/gram), a viscosity of 35.7 SSU at 100 degrees Fahrenheit, a specific gravity of 1.04 (60/60) and contained 24.0% sulfur and 11.9% phosphorous.

To the above mixture was added 87 parts by weight of zinc oxide, after which the whole was heated with agitation at about 54° C. for 4 hours until a pH of 6.7 was reached. After the water of neutralization had been removed, the oil solution contained 7.6% zinc, 15.0% sulfur and 7.2% phosphorous.

Another class of oil-soluble, phosphorous-containing, anti-wear compounds is the class of phosphoramides and phosphonamides that includes thiophosphoramides and thiophosphonamides such as those disclosed in U.S. Pat. Nos. 3,909,430 and 3,968,157, the disclosures of which are hereby incorporated by reference. These compounds may be prepared by forming a phosphorous compound having at least one P—N bond. They can be prepared, for example, by reacting phosphorous oxychloride with a hydrocarbyl diol in the presence of a monoamine or by reacting phosphorous oxychloride with a difunctional secondary amine and a mono-functional amine. Thiophosphoro amides can be prepared by reacting an unsaturated hydrocarbon compound containing from 2 to 450 or more carbon atoms, such as polyethylene, polyisobutylene, polypropylene, ethylene, 1-hexene, 1,3-hexadiene, isobutylene, 4-methyl-1-pentene, and the like, with phosphorous pentasulfide and a nitrogen-containing compound as defined above, particularly an alkylamine, alkyldiamine, alkylpolyamine, or an alkyleneamine, such as ethylene diamine, diethylenetriamine, triethylenetetramine, tetraethylenepentamine, and the like.

Still further phosphorous-containing compounds are oil-soluble phosphates, phosphonates, phosphinates, or phosphine oxides represented by the formula II:

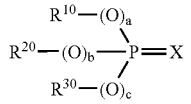

II where $R^{10}$, $R^{20}$ and $R^{30}$ are independently hydrogen or hydrocarbyl groups, X is oxygen or sulfur and a, b and c are independently 0 or 1.

The phosphorous-containing compounds can be an oil-soluble phosphite, phosphonite, phosphinite or phosphine compound which can be represented by the formula III:

III

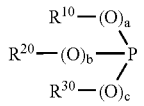

where $R^{10}$, $R^{20}$, $R^{30}$, a, b and c are as defined above.

The total number of carbon atoms in $R^{10}$, $R^{20}$ and $R^{30}$ in each of the above Formulae II and III must be sufficient to render the compound soluble in the lubricating oil used in formulating the inventive compositions. Generally, the total number of carbon atoms in $R^{10}$, $R^{20}$, and $R^{30}$ is at least about 8, and in one embodiment at least about 12, and in one embodiment at least about 16. There is no limit to the total number of carbon atoms in $R^{10}$, $R^{20}$ and $R^{30}$ that is required, but a practical upper limit is about 400 or about 500 carbon atoms. In one embodiment, $R^{10}$, $R^{20}$ and $R^{30}$ in each of the above formulae are independently hydrocarbyl groups of 1 to about 100 carbon atoms, or 1 to about 50 carbon atoms, or 1 to about 30 carbon atoms, with the proviso that the total number of carbons is at least about 8. Each $R^{10}$, $R^{20}$ and $R^{30}$ can be the same as the other, although they may be different. Examples of useful $R^{10}$, $R^{20}$ and $R^{30}$ groups include isopropyl, n-butyl, isobutyl, amyl, 4-methyl-2-pentyl, isooctyl, decyl, dodecyl, tetradecyl, 2-pentenyl, dodecenyl, phenyl, naphthyl, alkylphenyl, alkylnaphthyl, phenylalkyl, naphthylalkyl, alkylphenylalkyl, alkylnaphthylalkyl, and the like.

The phosphorous compounds represented by Formulae II and III can be prepared by reacting a phosphorous acid or anhydride with an alcohol or mixture of alcohols corresponding to $R^{10}$, $R^{20}$ and $R^{30}$ in Formulae II and III. The phosphorous acid or anhydride is generally an inorganic phosphorous reagent such as phosphorous pentoxide, phosphorous trioxide, phosphorous tetraoxide, phosphorous acid, phosphorous halide, or lower phosphorous esters, and the like. Lower phosphorous acid esters contain from 1 to about 7 carbon atoms in each ester group. The phosphorous acid ester may be a mono, di- or triphosphoric acid ester.

For a further discussion of the compounds of formulae II and III see, for example, U.S. Pat. No. 5,712,230 that is incorporated herein by reference in its entirety.

Still another class of phosphorous containing compounds is the class of oil-soluble, sulfur-containing phosphorous esters of formula IV:

IV

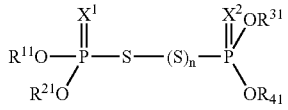

wherein $R^{11}$, $R^{21}$, $R^{31}$ and $R^{41}$ are independently hydrocarbyl groups, $X^1$ and $X^2$ are independently O or S, and n is zero to 3. In one embodiment $X^1$ and $X^2$ are each S, and n is 1. $R^{11}$, $R^{21}$, $R^{31}$ and $R^{41}$ are independently hydrocarbyl groups that are preferably free from acetylenic unsaturation and usually also free from ethylenic unsaturation. In one embodiment $R^{11}$, $R^{21}$, $R^{31}$ and $R^{41}$ independently have from about 1 to about 50 carbon atoms, and in one embodiment from about 1 to about 30 carbon atoms, and in one embodiment from about 1 to about 18 carbon atoms, and in one embodiment from about 1 to about 8 carbon atoms. Each of $R^{11}$, $R^{21}$, $R^{31}$ and $R^{41}$ can be the same as the other, although they may be different and mixtures may be used. Examples of $R^{11}$, $R^{21}$, $R^{31}$ and $R^{41}$ groups include isopropyl, butyl, n-butyl, isobutyl, amyl, 4-methyl-2-pentyl, octyl, isooctyl, decyl, dodecyl, tetradecyl, 2-pentenyl, dodecenyl, phenyl, naphthyl, alkylphenyl, alkylnaphthyl, phenylalkyl, naphthylalkyl, alkylphenylalkyl, alkylnaphthylalkyl, and mixtures thereof.

Procedures for preparing the compounds of formula IV are well known in the art and are described, for example, in U.S. Pat. No. 5,712,230 that is incorporated herein by reference in its entirety.

Still another class of oil-soluble, phosphorous-containing, anti-wear additives includes the amine phosphates and thiophosphates that are known in the art and disclosed, for example, in U.S. Pat. Nos. 3,859,218; 5,585,029; and 6,040,279, all of which are incorporated herein by reference in their entirety.

The amine phosphate for use in the compositions and methods herein includes commercially available monobasic hydrocarbyl amine salts of mixed mono- and di-acid phosphates and the amine salts of di-acid phosphate. The mono- and di-acid phosphates preferably have the structural formulae VA and VB:

VA

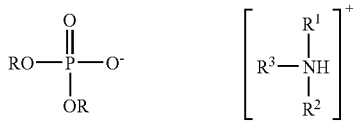

and

VB

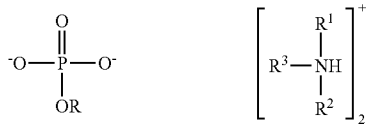

where each R is independently the same or different and are preferably $C_1$ to $C_{12}$ linear or branched chain alkyl; each of $R^1$ and $R^2$ are independently hydrogen or $C_1$ to $C_{12}$ linear or branched chain alkyl; $R^3$ is $C_4$ to $C_{12}$ linear or branched chain alkyl, or aryl-$R^4$ or $R^4$-aryl where $R^4$ is hydrogen or $C_1$ to $C_{12}$ linear or branched alkyl, and aryl is $C_6$.

The molar ratio of monoacid to diacid phosphate in the commercial amine phosphates used in this invention ranges from 3:1 to 1:3.

The mixed mono-/diacid phosphate and just the diacid phosphate can be used with the latter being the preferred. One embodiment of an acid aliphatic aromatic amine-phosphate is Vanlube RTM 692, sold commercially by the R. T. Vanderbilt Company, Inc.

The Oil of Lubricating Viscosity

The oil of lubricating viscosity used in the compositions and methods of this invention may be mineral oils or synthetic oils of viscosity suitable for use in the crankcase of an internal combustion engine. The base oils may be derived from synthetic or natural sources. Mineral oils for use as the base oil in this invention include paraffinic, naphthenic and other oils that are ordinarily used in lubricating oil compositions. Synthetic oils include both hydrocarbon synthetic oils and synthetic esters. Useful synthetic hydrocarbon oils include liquid polymers of alpha olefins having the proper viscosity. Especially useful are the hydrogenated liquid oligomers of $C_6$ to $C_{12}$ alpha olefins such as 1-decene trimer. Likewise, alkyl benzenes of proper viscosity, such as didodecyl benzene, can be used. Useful synthetic esters include the esters of monocarboxylic acids and polycarboxylic acids, as well as monohydroxy alkanols and polyols. Typical examples are didodecyl adipate, pentaerythritol tetracaproate, di-2-ethylhexyl adipate, dilaurylsebacate, and the like. Complex esters prepared from mixtures of mono and dicarboxylic acids and mono and dihydroxy alkanols can also be used. Blends of mineral oils with synthetic oils are also useful.

Formulations

The compositions of this invention comprise the following:

an oil of lubricating viscosity;

at least one oil-soluble, phosphorous-containing, anti-wear compound wherein the total phosphorous employed in the composition is no more than about 0.08 weight percent based on the total weight of the composition (preferably no more than 0.06 weight percent);

an anti-wear effective amount of a dispersed, hydrated alkali metal borate, and optional additives.

In a particularly preferred embodiment, one optional additive employed in the compositions of this invention is an overbased detergent.

Preferably, the amount of dispersed, hydrated alkali metal borate employed in these compositions is from about 0.2 to about 5 weight percent (preferably from about 0.5 to about 2 weight percent based on the total weight) based on the total weight of the composition.

Preferably, the amount of oil of lubricating viscosity ranges up to about 99 weight percent of the composition based on the total weight of the composition.

These compositions are prepared merely by mixing the appropriate amounts of each of these components until a homogenous composition is obtained.

The following additive components are examples of some of the components that can be optionally employed in the compositions of this invention. These examples of additives are provided to illustrate the present invention, but they are not intended to limit it:

(1) Metal Detergents: sulfurized or unsulfurized alkyl or alkenyl phenates, alkyl or alkenyl aromatic sulfonates, sulfurized or unsulfurized metal salts of multi-hydroxy alkyl or alkenyl aromatic compounds, alkyl or alkenyl hydroxy aromatic sulfonates, sulfurized or unsulfurized alkyl or alkenyl naphthenates, metal salts of alkanoic acids, metal salts of an alkyl or alkenyl multiacid, and chemical and physical mixtures thereof.

A preferred class of metal detergents are overbased detergents. Overbased detergents include overbased metallic detergents preferably having a TBN of greater than about 50 and more preferably greater than about 200 and even more preferably greater than about 250. Preferred metals in such metallic detergents include alkali and alkaline earth metals such as lithium, sodium and potassium. Particularly preferred metals include calcium and magnesium and especially calcium. Typical overbased detergents include overbased phenates, salicylates and sulfonates which typically have a TBN of up to about 550.

(2) Oxidation Inhibitors (a) Phenol type oxidation inhibitors: 4,4'-methylene bis (2,6-di-tertbutylphenol), 4,4'-bis(2,6-di-tert-butylphenol), 4,4'-bis(2-methyl-6-tert-butylphenol), 2,2'-methylene bis(4-methyl-6-tert-butylphenol), 4,4'-butylene bis(3-methyl-6-tert-butylphenol), 4,4'-isopropylene bis(2,6-di-tert-butylphenol), 2,2'-methylene bis(4-methyl-6-nonylphenol), 2,2'-isobutylene bis(4,6-dimethylphenol), 2,2'-methylene bis(4-methyl-6-cyclohexylphenol), 2,6-di-tert-butyl-4-methylphenol, 2,6-di-tert-butyl-4-ethylphenol, 2,4-dimethyl-6-tert-butylphenol, 2,6-di-tert-.alpha.-dimethylamino-p-cresol, 2,6-di-tert-4-(N.N'dimethylaminomethylphenol), 4,4'-thiobis(2-methyl-6-tert-butylphenol), 2,2'-thiobis(4-methyl-6-tert-butylphenol), and bis(3-methyl-4-hydroxy-5-tert-butylbenzyl)-sulfide.

(b) Diphenyl amine type oxidation inhibitor: alkylated diphenyl amine, phenyl-.alpha.-naphthylamine, and alkylated.alpha.-naphthylamine.

(c) Other types: metal dithiocarbamate (e.g., zinc dithiocarbamate), and methylenebis (dibutyidithiocarbamate).

(3) Rust Inhibitors (Anti-Rust Agents)

(a) Nonionic polyoxyethylene surface active agents: polyoxyethylene lauryl ether, polyoxyethylene higher alcohol ether, polyoxyethylene nonyl phenyl ether, polyoxyethylene octyl phenyl ether, polyoxyethylene octyl stearyl ether, polyoxyethylene oleyl ether, polyoxyethylene sorbitol monostearate, polyoxyethylene sorbitol mono-oleate, and polyethylene glycol monooleate.

(b) Other compounds: stearic acid and other fatty acids, dicarboxilic acids, metal soaps, fatty acid amine salts, metal salts of heavy sulfonic acid, partial carboxylic acid ester of polyhydric alcohol, and phosphoric ester.

(4) Demulsifiers:

addition product of alkylphenol and ethylene oxide, poloxyethylene alkyl ether, and polyoxyethylene sorbitan ester.

(5) Extreme Pressure Agents (EP Agents):

sulfurized oils, diphenyl sulfide, methyl trichlorostearate, fluoroalkyl-polysiloxane, and lead naphthenate.

(6) Friction Modifiers:

fatty alcohol, fatty acid, amine, borated ester (such as borated glycerol monooleate), and other esters.

(7) Multifunctional Additives:

sulfurized oxymolybdenum dithiocarbamate, sulfurized oxymolybdenum organo phosphoro dithioate, oxymolybdenum monoglyceride, oxymolybdenum diethylate amide, amine-molybdenum complex compound, and sulfur-containing molybdenum complex compound.

(8) Viscosity Index Improvers:

polymethacrylate type polymers, ethylene-propylene copolymers, styrene-isoprene copolymers, hydrated styrene-isoprene copolymers, polyisobutylene, and dispersant type viscosity index improvers.

(9) Pour Point Depressants:

polymethyl methacrylate.

(10) Foam Inhibitors:

alkyl methacrylate polymers and dimethyl silicone polymers.

Preferably, the compositions of this invention do not include any liquid chlorinated paraffins.

EXAMPLES

The invention will be further illustrated by the following examples, which set forth particularly advantageous method embodiments. While the examples are provided to illustrate the present invention, they are not intended to limit it.

As used in these examples and elsewhere in the specification, the following abbreviations have the following meanings. If not defined, the abbreviation will have its art recognized meaning.

| | |
|---|---|
| cSt = | centiStokes |
| mL = | milliliters |
| mm = | millimeters |
| MW = | molecular weight |
| ppm = | parts per million |
| s = | seconds |
| TBN = | total base number |
| VI = | viscosity index |

In addition, all percents recited below are weight percents based on the total weight of the composition described unless indicated otherwise.

Comparative Example 1

The purpose of this comparative example is to measure the effect on wear in an internal combustion engine arising from lowering the amount of a known anti-wear agent (zinc dithiophosphate) by approximately 50% in a lubricant composition employed to lubricate an internal combustion engine.

Specifically, two fully formulated lubricating oil compositions were prepared using the following additives:

| | |
|---|---|
| Succinimide dispersant (2300 MW) | 2.9 weight percent |
| Borated succinimide dispersant (1300 MW) | 1.8 weight percent |
| High overbased calcium phenate detergent (250 TBN) | 55 millimoles |
| Zinc dithiophosphate (sufficient to provide 0.0475 or 0.095 weight percent phosphorous) | |
| antioxidant | 1.0 weight percent |
| VI improver | 4.5 weight percent |
| antifoam | 5 ppm |
| pour point depressant | 0.3 weight percent |

In each case, the balance of the composition comprised a base stock comprising a Group II base oil having a kinematic viscosity of 4.5 cSt at 100° C. to provide for a 5W20 oil.

The composition comprising 0.0475 weight percent phosphorous as zinc dithiophosphate is referred to hereafter as "0.0475% P" and the composition comprising 0.095 weight percent phosphorous as zinc dithiophosphate is referred to hereafter as "0.095% P".

These comparative compositions described were tested for wear performance in a Sequence IVA engine test. The Sequence IVA test evaluates a lubricant's performance in preventing camshaft lobe wear in an overhead camshaft engine. More specifically, the test measures the ability of crankcase oil to control camshaft lobe wear for spark-ignition engines equipped with an overhead valve-train and sliding can followers. This test is to simulate service for taxicab, light-delivery truck, or commuter vehicles.

The Sequence IVA test method is a 100-hour test involving 100 hourly cycles; each cycle consists of two operating modes or stages. Unleaded "Haltermann KA24E Green" fuel is used. The text fixture is a KA24E Nissan 2.4-liter, water-cooled, fuel-injected engine, 4-cylinder in-line, overhead camshaft with two intake valves, and one exhaust valve per cyclinder.

At the end of the test, each of the 12 cam lobes is measure at seven locations using a profilometer, which measures maximum depth of wear. Measurements of wear on all seven positions of each lobe are added; then all 12 lobe measurements are averaged for the wear result. This result is the primary evaluation for the test. Secondary results can include cam lobe nose wear and engine oil parameters. At 100 hours, the used oil is evaluated for: kinematic viscosity; fuel dilution; and wear metals iron (Fe) and copper (Cu). Pass/fail criteria include average cam wear of 120 mm maximum. This test is currently under consideration as an ASTM standard and is currently performed by commercial engine test laboratories in accordance with draft No. 6 having a revision date of January 2002.

In this engine test, wear is measured in microns of metal removed from the cam lobe and is reported as ACW uncorrected. Higher values of metal removed correspond to poor wear properties of the oil. The results of this evaluation are set forth in the table below:

| Example | Amount of Wear |
|---|---|
| Comparative Example (0.0475% P) | 332.3 microns |
| Comparative Example (0.095% P) | 45.6 microns |

These results evidence that by lowering the amount of phosphorous in the composition (due to zinc dithiophosphate) by 50% results in an approximate 7 fold increase in wear.

Example 1

The purpose of this example is to demonstrate that acceptable wear performance is achieved using less than 0.08 weight percent phosphorous in the lubricant composition when the composition comprises a dispersed, hydrated, alkali metal borate.

Specifically, two fully formulated lubricating oil compositions were prepared using the following additives:

| | |
|---|---|
| Succinimide dispersant (2300 MW) | 2.8 weight percent |
| Low overbased calcium sulfonate degergent | 5.5 millimoles |
| High overbased calcium phenate detergent | 55 millimoles |
| Zinc dithiophosphate (sufficient to provide 0.03 or 0.095 weight percent phosphorous) | |
| VI improver | 9.4 weight percent |

In each case, the balance of the composition comprised a base stock comprising a Group II base oil having a kinematic viscosity of 10.4 cSt at 100° C. to provide for a SAE viscosity grade 5W30 oil.

Since these compositions did not include any dispersed, hydrated alkali metal borate, these compositions were labeled "Comparative Example C" (0.03 weight percent phosphorus) and "Comparative Example D" (0.095 weight percent phosphorus).

Two further formulations, identical to Comparative Examples C and D above were prepared with the exception that these compositions further comprised 2 weight percent of a dispersed, hydrated potassium borate composition (OLOA 9750®—available from Chevron Oronite Company, LLC, Houston, Tex. USA). Both of these compositions are compositions of this invention which were labeled Examples 2A (0.03 weight percent phosphorus) and 2B (0.095 weight percent phosphorus).

The compositions described above were tested for wear performance in a Mini-Traction Machine (MTM) bench test. The MTM is manufactured by PCS Instruments and operates in the pin-on-disk configuration in which a stationary pin (0.25 inches 8620 steel ball) is loaded against a rotating disk (32100 steel). The conditions employ a load of 25 Newtons, a speed of 500 mm/s and a temperature of 150° C.

In this bench test, wear is measured in microns of metal removed between the pin and the disk. Higher values of metal removed correspond to poor wear of the oil. The results of this evaluation are set forth in the table below:

| Example | Amount of Wear |
|---|---|
| Comparative Example C | 22.7 microns |
| Comparative Example D | 7.3 microns |
| Example 2A | 8.6 microns |
| Example 2B | 7.4 microns |

These results evidence that in the absence of the dispersed, hydrated, alkali metal borate, significant wear occurred at a phosphorus level of approximately 0.03 weight percent and that approximately 3 times the amount of phosphorus was required to reduce wear to 7.3 microns. These results further evidence that in the presence of 2 weight percent of the dispersed, hydrated potassium borate composition, acceptable wear results were achieved (8.6 microns) using only 0.03 weight percent phosphorus.

From the foregoing description, various modifications and changes in the above described invention will occur to those skilled in the art. All such modifications coming within the scope of the appended claims are intended to be included therein.

What is claimed is:

1. A method for controlling wear during operation of an internal combustion engine, which method comprises operating the engine with a lubricant composition comprising a major amount of an oil lubricating viscosity, at least one oil-soluble, phosphorous-containing, anti-wear compound wherein the weight percent of total phosphorous in the composition is no more than about 0.08 weight percent based on the total weight of the composition and an anti-wear effective amount of a dispersed, hydrated, alkali metal borate.

2. The method according to claim 1 wherein the total phosphorous in the composition is no more than 0.05 weight percent based on the total weight of the composition.

3. The method according to claim 1 wherein the oil-soluble, phosphorous-containing, anti-wear compound is selected from the group consisting of metal dithiophosphates, phosphorous esters, amine phosphates and amine phosphinates, sulfur-containing phosphorous esters, phosphoramides and phosphonamides.

4. The method according to claim 3 wherein phosphorous esters are selected from the group consisting of phosphates, phosphonates, phosphinates, phosphine oxides, phosphites, phosphoniates, phosphinites, and phosphines.

5. The method according to claim 3 wherein said sulfur-containing phosphorous esters are selected from the group consisting of phosphoro monothionate and phosphoro dithionates.

6. The method according to claim 5 wherein the phosphorous containing compound is a metal dithiophosphate.

7. The method according to claim 6 wherein the metal dithiophosphate is a zinc dialkyldithiophosphates.

* * * * *